United States Patent [19]

Jerde

[11] 3,990,838

[45] Nov. 9, 1976

[54] BURNER FOR MIXTURES OF AIR AND GAS

[75] Inventor: James B. Jerde, Mountain View, Calif.

[73] Assignee: Digital Dynamics, Inc., Sunnyvale, Calif.

[22] Filed: May 9, 1975

[21] Appl. No.: 576,008

[52] U.S. Cl. ..... 431/354; 239/594

[51] Int. Cl.[2] ..... B05B 1/04

[58] Field of Search ..... 431/354, 355; 239/433, 239/434.5, 592, 594, 593; 48/180 C

[56] References Cited

UNITED STATES PATENTS

| | | | |
|---|---|---|---|
| 1,067,069 | 7/1913 | Smith | 239/594 X |
| 2,092,897 | 9/1937 | Sudhaus | 239/592 |
| 2,296,715 | 9/1942 | Komar | 239/592 |
| 3,501,098 | 3/1970 | Evans | 431/354 X |

*Primary Examiner*—William R. Cline

*Attorney, Agent, or Firm*—Lothrop & West

[57] ABSTRACT

A burner for mixtures of air and gas has a generally closed burner body extending along an axis. There is an entrance portion at one end of the body open to the atmosphere and an exit portion at the other end of the body having a second opening to the atmosphere. The body is generally defined between a relatively flat top plate and a converging, relatively flat bottom plate and between curved side plates to establish a rectangular enclosure. The entrance portion decreases in transverse cross-sectional area away from the entrance opening to a high-velocity zone having a minimum transverse cross-sectional area from which the exit portion flares between the central zone and the exit opening with a substantially constant cross-sectional area. A gas tube extends along the axis through the entrance opening and into the entrance portion to a point somewhat short of the high-velocity zone.

3 Claims, 6 Drawing Figures

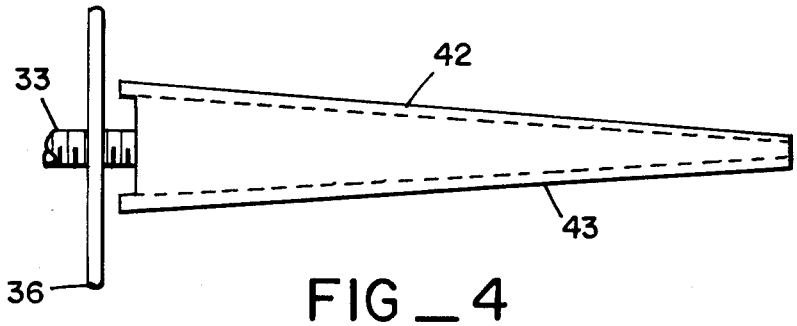
FIG_4
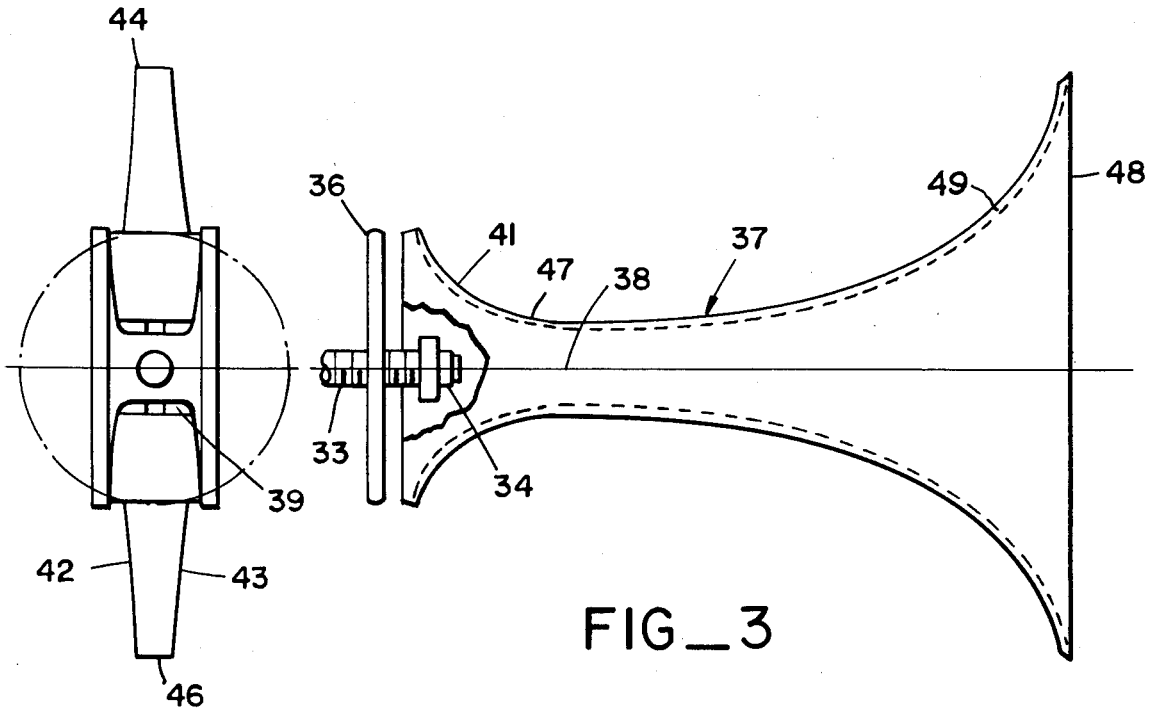
FIG_3
FIG_5
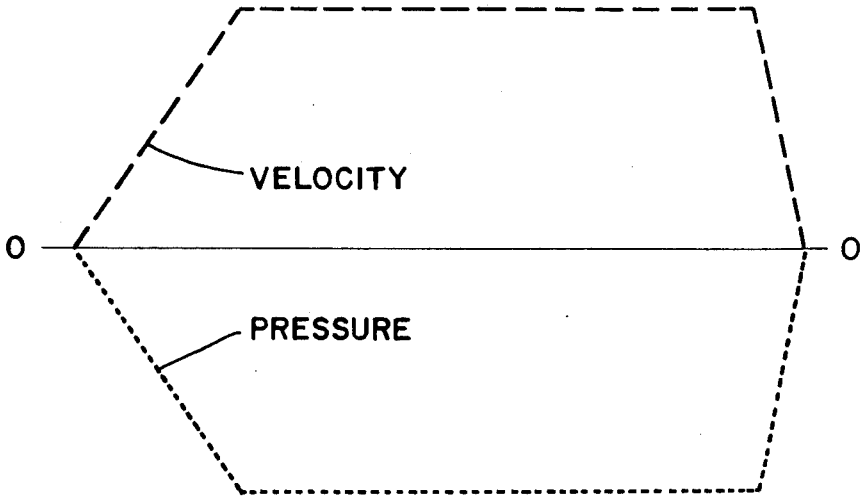
FIG_6

BURNER FOR MIXTURES OF AIR AND GAS

In the burning of gas-air mixtures; for example, burning natural gas or propane and the like with air, it is customary to provide a burner which is primarily a mixer and that has a flame-supporting outlet. A typical burner has variable flow characteristics, depending partly on the rate at which it is employed, and sometimes affords relatively non-uniform combustion and sometimes, when turned down, has a characteristic of popping back or burning away from the customary burning outlet.

It is therefore an object of the invention to provide a burner in which the combustion characteristics over a wide range of operation are satisfactory.

Another object of the invention is to provide a burner construction that is substantially cheaper to produce than burners heretofore available.

Another object of the invention is to provide a burner that can be fabricated and maintained with economical and effective techniques.

A further object of the invention is to provide a burner which can readily be substituted for burners already in operation.

A still further object of the invention is to provide a burner with a readily controlled combustion characteristic.

A further object is in general to provide an improved burner.

Other objects, together with the foregoing, are attained in the embodiment of the invention described in the accompanying description and illustrated in the accompanying drawings, in which:

FIG. 3 is a view comparable to FIG. 1 but showing the improved burner of the invention;

FIG. 4 is a side elevation of the burner shown in FIG. 3;

FIG. 5 is an end elevation of the burner of FIG. 3; and

FIG. 6 is a diagram comparable to FIG. 2 but showing the velocity and pressure characteristics of the burner of FIGS. 3, 4 and 5.

Figure 1:
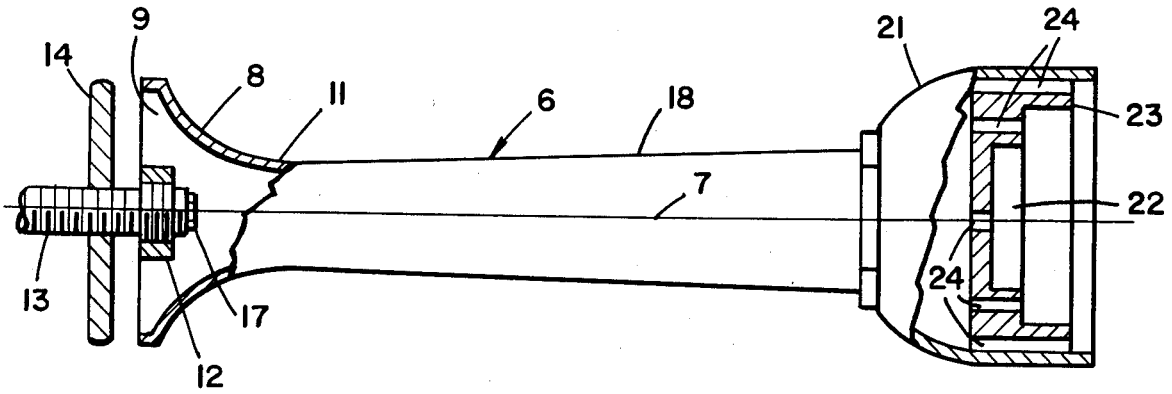
FIG. 1 is a side elevation of a standard, or prior art, burner, portions being broken away to disclose the interior construction.

As a representative prior art burner over which the present burner is distinguished, there is shown in FIG. 1 a burner 6 generally symmetrical about a longitudinal axis 7. The burner 6 is customarily circular in all transverse cross-sections. The generally circular body 6 has an entrance portion, generally designated 8, which reduces in size from an atmospheric inlet opening 9 toward a minimum cross-sectional area or throat 11. Spanning the inlet section 8 is a bridge 12 carrying a threaded inlet pipe 13 for the gas fuel. The threaded pipe 13 carries a throttle disc 14 which can be screwed toward and away from the opening 9 to regulate the ratio of entrance air to the amount of gas issuing from the pipe 13 through an orifice tip 17. The incoming gas induces an influx of atmospheric air, and mixture of the gas and air takes place within a flaring or diffuser portion 18 of the burner. From the minimum cross-sectional throat 11, the mixed gases expand in the flaring tube until they arrive at an enlarged exit section 21 leading to an opening 22 to the atmosphere. Interposed in the exit section is a burner plate 23 having a number of small openings 24 therein. When ignited, the gas-air mixture burns with additional atmospheric air as a generally columnar or circular flame adjacent the outlet of the section 21. It is customary to cast the burner body as a unit or as a few pieces, and, while this is fairly efficacious, it is relatively heavy and expensive.

Figure 2:
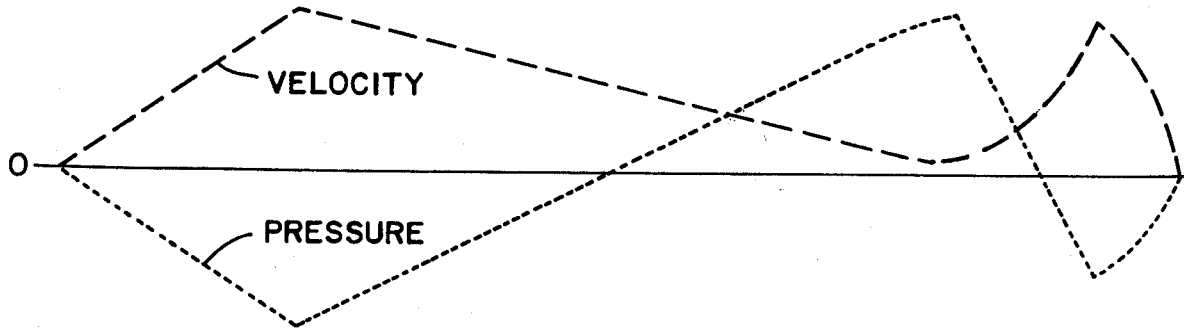
FIG. 2 is a diagram showing the velocity of fluid flow through the burner of FIG. 1 as well as the pressure existing at different parts of the operating burner as disclosed in FIG. 1.

More particularly, there are difficulties in the device as described, as is apparent from the graph of FIG. 2 in which there is indicated both the velocity and pressure situations. Beginning with atmospheric pressure, the incoming gas exiting from the orifice tip 17 induces the influx of atmospheric air. The internal pressure as measured along the axis 7 decreases from near the entrance to a minimum value in the throat zone 11. In the diffusing section 18 which immediately follows, the pressure recovers from a subatmospheric value and actually achieves a value above atmospheric adjacent the vicinity of the burner plate 23. Thereafter, due to efflux through the various orifices 24, the pressure again drops, sometimes to a value somewhat below atmospheric at the actual exit of the burner and then, in or adjacent the beginning of the flame, increases to achieve an atmospheric value again.

Since the pressure varies as indicated, there is a corresponding variation in velocity. As shown in FIG. 2, as the pressure decreases the velocity increases, until in the area of the throat zone 11 the velocity is a maximum. The velocity then decreases gradually toward a location near the burner plate 23, whereupon the velocity again increases as it passes through the various openings to a relative high value at the exit of the burner and then falls to virtually a zero value when the pressure approaches atmospheric.

I have found that, because of the non-uniform relationships of velocity to burner length and pressure to burner length, the burner operation is somewhat erratic over the burning range. Also, when turned down, the flame tends to pop back toward the inlet opening 9. I have, therefore, provided a burner pursuant to the invention as disclosed in FIGS. 3 to 6, inclusive. In this instance, the gas pipe 33 and the nozzle 34 as well as the throttle disc 36 are retained. These are provided in association with a burner 37 which is generally symmetrical about a longitudinal axis 38 but is not circular in any cross-section.

The burner 37 has a first, inlet opening 39 to the atmosphere formed by an inlet portion 41. This is defined in a rectangular cross-sectional shape by an upper plate 42 that is substantially flat and by a symmetrical lower plate 43 also substantially flat and is also defined by a pair of curved side walls 44 and 46 having an especial configuration. The top and bottom walls 42 and 43 conveniently are spaced a substantial distance from the axis 38 near the inlet end and converge away from the inlet end to a relatively narrower opening 48 at the outlet end.

The walls 44 and 46 converge initially away from the inlet opening 39 toward a relatively narrow restricted section or throat 47 and then diverge in a particular manner in a final portion 49 from the throat section toward the outlet opening 48 and to the atmosphere. The curvature of the initial portion 41 allows for a reduction of cross-sectional area, but the curvature of the final portion is such that the cross-sectional area of the burner from the throat to the outlet remains substantially constant throughout. This is generally true throughout the length of the burner beyond the throat, taking the convergence of the top and bottom flat walls into account. The volume occupied by the pipe 33 and the nozzle 34 and any bridge within the inlet portion is somewhat restrictive; nevertheless, the pipe and burner nozzle extend into the inlet only a short distance and stop short of the throat 47. Their presence assists in providing an initially converging net, cross-sectional area.

With the configuration shown, the pressure events are as illustrated in FIG. 6, in which the pressure begins at substantially an atmospheric value near the throttle disc 36 and then, due to the induced air inflow by gas emerging from the nozzle 34, drops to a low value in the vicinity of the throat 47. In contradistinction to a standard burner, the pressure is maintained at a substantially constant, low, subatmospheric value throughout substantially the entire length of the remaining part of the burner, increasing from its subatmospheric value back to atmospheric value at a short distance downstream of the outlet opening 48. It is especially noteworthy that between the throat and the outlet the interior pressure has substantially a fixed or predetermined constant value.

Correspondingly, the velocity of flow increases from substantially a zero value in the vicinity of the throttle disc 36 and rises to a maximum value in the vicinity of the throat 47 and remains substantially constant at the maximum value as the gas flows through the remaining part of the burner. The velocity then drops beyond the outlet opening 48 back to a substantially atmospheric value somewhere in the vicinity of the beginning flame.

With this arrangement, the combustion is uniform over a wide range of operation and there is no popping back of the flame when it is turned down. The construction is easily and inexpensively made, the weight is light and the new burner can readily replace burners of the prior art type. The convergence of the top and bottom plates and the curvature of the side walls can readily be chosen, and computations for equal cross-sectional area can be made readily, especially by computer. While the favored shape in one aspect is something like an amplifying horn, it is found in practice that the flow and flame are exceptionally stable at each flow rate over a wide range of flow rates, that acoustic excitation does not occur (at least in normally audible ranges), and that at both low and high outputs, and in between, the burner is quiet. The combustion is good, being substantially devoid of reverberatory effects, so that burner walls can be of relatively light materials.

What is claimed is:

1. A burner for mixtures of air and gas comprising a hollow, substantially closed burner body extending symmetrically along an axis and being rectangular in internal cross-section in all planes normal to said axis, said body having planar top and bottom walls and having an entrance portion with a rectangular inlet opening from the atmosphere at one end and an exit portion with a rectangular outlet opening to the atmosphere at the other end, said body in said entrance portion having smoothly curved side walls and decreasing in cross-sectional area transverse to said axis from said inlet opening to a throat having a minimum cross-sectional area, said body in said exit portion having smoothly curved side walls and continuing the cross-sectional area of said throat transverse to said axis between said throat and said outlet opening.

2. A burner as in claim 1 in which said flat top wall and said flat bottom wall converge uniformly between said inlet opening at said entrance portion and said outlet opening at said exit portion.

3. A burner as in claim 2 in which said curved side walls diverge substantially into transverse planes at said inlet opening and said outlet opening.

* * * * *